United States Patent [19]

Birman

[11] 4,223,863

[45] Sep. 23, 1980

[54] SHELF SUPPORTS

[76] Inventor: Josef Birman, 81a Acco Rd., Kiryat Motzkin, Israel

[21] Appl. No.: 946,730

[22] Filed: Sep. 28, 1978

[51] Int. Cl.[2] ..... A47G 29/02

[52] U.S. Cl. ..... 248/246; 108/108

[58] Field of Search ..... 248/243, 246, 245, 248; 108/108; 211/90, 190, 193, 207, 135, 102

[56] References Cited

U.S. PATENT DOCUMENTS

| | | | |
|---|---|---|---|
| 2,677,519 | 5/1954 | Hobson | 211/207 X |
| 3,516,635 | 6/1970 | Niet | 211/207X |
| 3,664,627 | 5/1972 | Sykes et al. | 248/246 |
| 3,854,686 | 12/1974 | Konstant | 108/108 X |
| 4,040,588 | 8/1977 | Papsco | 211/193 X |
| 4,056,196 | 11/1977 | Brauning | 211/207 |
| 4,065,904 | 1/1978 | Taylor et al. | 108/108 X |
| 4,103,855 | 8/1978 | Grosse | 211/90 X |

FOREIGN PATENT DOCUMENTS

| | | | |
|---|---|---|---|
| 1289968 | 2/1969 | Fed. Rep. of Germany | 108/108 |
| 2263841 | 7/1973 | Fed. Rep. of Germany | 108/108 |
| 1388531 | 4/1964 | France | 248/246 |

*Primary Examiner*—J. Franklin Foss

*Attorney, Agent, or Firm*—John S. Roberts, Jr.

[57] ABSTRACT

The present invention relates to a support structure for shelves suitable for ready changing of the height and the relative distance between individual shelf boards.

The support structure consists of vertical members adapted to be fastened to another vertical structure and of brackets adapted to be moved along the vertical members and to be held therein by frictional locking forces. Each vertical member has a uniform cross section in the shape of a rectangular, assymetrical channel comprising a web, a base flange provided with means for attaching it adjacent to a wall and an outer smaller-width flange provided along its outer with a re-entrant first guide parallel to the plane of the web. Inside the base flange is provided a second guide ridge, which faces the first guide ridge, but at a greater distance from the web than the first guide ridge. Each bracket is in the shape of a rigid angle plate having an inner end and an outer end, the inner end being positioned in a vertical member with its axis perpendicular to the plane of the base flange. The inner end comprises a vertical side plate of a height smaller than the bracket length which side plate is positioned outside and adjacent to the first guide ridge and parallel to the plane of the web, and a horizontal top plate of a width commensurate with the width of the outer flange. The top plate is divided by a cross-wise extending cut-out into an inner portion corresponding in shape and size to the inner space of the vertical member and into an outer portion distanced from the outer channel flange by a gap sufficient to allow tilting of the bracket in its vertical plane for the sidewise insertion of the inner portion into the inner space of the vertical member.

6 Claims, 7 Drawing Figures

SHELF SUPPORTS

Figure 1:
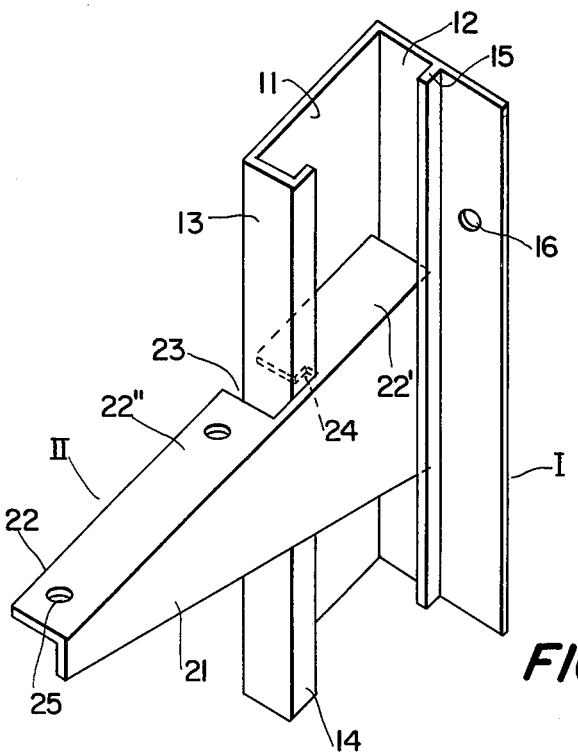

The invention relates to a support structure for shelves suitable for ready changing of the height and the relative distance between individual shelf boards. It relates more especially to shelves to be fastened to a wall or another vertical structure.

Existing shelf supports commonly consist of vertical channels or suitably shaped bars fastened to a wall at given horizontal distances, and brackets fixed to these channels or bars, every two of which support a horizontally positioned wooden, metal or plastic board of suitable length and width. For the purpose of fastening the brackets to the channels, the latter are provided with equidistant perforations into which hook-like projections on the brackets are inserted and fixed.

The drawback of these supports is that the board or shelf can be positioned at definite height intervals only, and that all channels of one set require fastening to the wall with their corresponding perforations perfectly levelled so as to obtain an exact horizontal position of all shelves. Another drawback is that changing the position of one shelf usually requires a major effort, especially after the brackets had been located in a specific perforation for a longer period and settled therein.

With a view to enabling fixation of shelves at any desired level, independent of spaced perforations in the vertical channels or bars, and to enabling easy shifting of shelves and brackets in vertical direction. shelf supporting structures have been designed which comprise brackets held in position in suitably shaped channels by frictional locking. A structure of this type is described in Israel Patent Application No. 50531, wherein brackets of T-shaped cross section are inserted with their suitably formed inner ends into lipped box channels and are held therein by friction forces created between bracket and channel by the moment of the load on the shelf.

Each bracket is in the shape of a rigid angle plate positioned in a vertical member with its axis perpendicular to the plane of the base flange and comprises a vertical side plate of a height smaller than the bracket length, which side plate is positioned outside and adjacent to the first guide ridge parallel to the plane of the web, and at its inner end adjacent to the insise face of the second guide ridge, and a horizontal top plate of a width commensurate with thw shorter flange of the channel member extending from the top of the side plate in the direction of the channel web. The top plate is furthermore divided into an inner portion and an outer portion by a cut-out extending from the outer edge of the top plate to the side plate, in such a manner that the inner portion corresponds in its shape to the inner space of the channel member with sufficient clearance to permit its sliding movement up and down the member. The outer end of the cut-out is distanced from the outer flange of the vertical member, thus defining the outer bracket portion and providing sufficient clearance between the latter and the flange to allow tilting of the bracket in its vertical plane for its insertion into the channel. The bracket top plate is provided with means for fastening thereto a shelf board such as, for instance, with holes for wood screws to pass through. The base flange of the channel member is preferably provided with holes on the side remote from the inner channel space, for fixation of the member to a wall or the like by means of bolts or screws. Along both sides of these holes longitudinal projections may be provided for insertion of a resilient strip of material therebetween, for the purpose of hiding the bolt heads.

Figure 3:
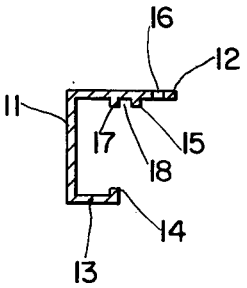
Figure 4:
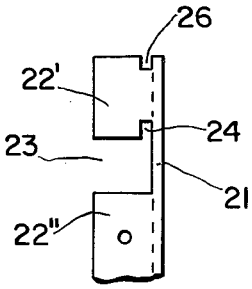
Figure 5:
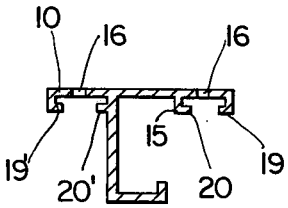
Figure 6:
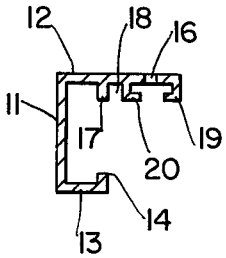
Figure 7:
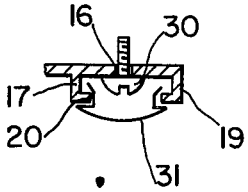

With a view to fasten the member to a wall on both sides of the channel proper, the base flange may be extended to the other channel side beyond the web, and this extension may be similarly provided with holes for fixing the member by means of bolts. In the accompanying drawing which illustrates, by way of example, certain embodiments of both the vertical member and the bracket, FIG. 1 is a perspective view of a portion of a vertical member with a bracket inserted, FIG. 2 is a view of the top portion of the bracket illustrated in FIG. 1, FIG. 3 is a horizontal section through a vertical member provided with two parallel guide ridges along the base flange, FIG. 4 is a plan view of a bracket suitable for insertion into the channel of FIG. 3, FIG. 5 is a horizontal section through a vertical member provided with two sets of holes in the base flange, FIG. 6 is a horizontal section through a vertical member as per FIG. 3, provided with projections on both sides of the bolt holes, and FIG. 7 is an enlarged section of the right-hand side of the channel member of FIG. 6 showing a resilient cover strip inserted between the projections.

Figure 2:
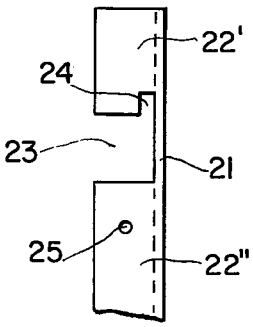

With reference to FIGS. 1 and 2 of the drawing, a vertical channel member I (a short section of which is shown here) comprises a web II, a base flange 12 and an outer flange 13.

A first, re-entrant guide ridge 14 is formed at the outer edge of the outer flange 13, and facing this ridge a second guide ridge 15 is formed on the inside of the base flange, but at a somewhat greater distance from the web II than the first guide ridge. Holes 16 (one only shown) are provided in the base flange, on the side remote from the channel proper, and serve to fasten the member by bolts or screws to a wall or a structure.

A bracket II is shown to be inserted and held in position in the member I. It consists of a vertical side plate 21 which is obliquely cut along its lower edge, thus forming a higher inner and a lower outer end, and of a horizontal top plate 22. The top plate is divided into an inner portion 22' and an outer portion 22'' by a cut-out 23 extending across its entire width to the side plate 21. The cut-out is enlarged in its inner corner to form a rectangular notch 24 which corresponds in size and position to the first guide ridge 14. Two holes 25 are provided in the top plate for connecting to it a shelf by means of screws bolts or rivets.

The insertion of a bracket into a vertical member as shown in FIG. 1, is done through the open channel side, by tilting the bracket in its vertical plane until the inner portion 22' can pass through this opening. The bracket is prevented from tilting sideways by the two guide ridges 14 and 15 against which the side plate 21 leans on opposite sides. In addition, the width of the inner portion equals the width of the inner space of the channel, keeping the side plate close to the said ridges. The load acting on the shelf creates horizontal forces between the bracket and the channel member which prevent slipping down of the bracket by inherent friction forces acting on the loaded edges of the bracket in a known manner. It is selfevident that a heavier load creates a greater friction force and vice versa.

The channel member of FIG. 3 and the bracket of FIG. 4 are characterised by that the side plate 21 is additionally guided on its inside by a third ridge 17 projecting out of the base flange parallel to the second ridge 15 and exactly opposite the first guide ridge 14, the two ridges 15 and 17 thus forming between them a groove 18 in which the vertical side plate 21 is guided on both its sides. The top plate is accordingly provided with a second notch 26 cutting into the inner edge of the top plate adjacent to the side plate and corresponding in size to the guide ridge 17.

The vertical member illustrated in FIG. 6 is similar to the member of FIG. 3, i.e. it is provided with a groove 18 between two ridges 15' and 17. An additional feature is an angular projection 19 formed along the outer edge of the base flange and—opposite this projection—a ledge 20 running along the end of the ridge 17. The parts 19, 17 and 20 form a semi-closed lipped channel surrounding the fixation holes 16 on the flange as well as the bolt heads 30 shown in FIG. 7. A flexible, bent strip 31 can be inserted into the above semi-closed channel for the purpose of covering the bolt heads and holes and of presenting a smooth, pleasant exterior of the member.

The member of FIG. 5 is provided with a continuation 10 of the base flange in the shape of a narrow strip projecting on the opposite side of the web 11. This continuation is provided with holes 16' symmetrically to the holes 16 on the other side of the flange. Both sets of holes are enclosed in semi-closed channels as illustrated in FIGS. 6 and 7 adapted for the insertion of flexible strips 31. The present embodiment differs from that of FIG. 6 in that only one projection 15 is provided as guide ridge and not two ridges forming a groove 18 therebetween.

The channel members are preferably manufactured by extrusion of a light metal alloy, while the brackets lend themselves to ready production by cutting, bending and stamping of sheet metal.

Other embodiment than those described and illustrated in the foregoing may be designed and conceived at the hands of person skilled in the art, by adhering to the spirit of the invention and the scope of the appended claims.

I claim:

1. A shelf support structure consisting of vertical members adapted to be fastened to a wall or another vertical structure, and of brackets adapted to be moved along the vertical members and to be held therein by frictional locking forces, wherein each vertical member has a uniform cross section in the shape of a rectangular, asymmetrical channel comprising a web, a larger-width flange and an outer, smaller-width flange provided along its outer edge with a re-entrant first guide ridge parallel to the plane of the web, a second guide ridge being provided on the inside of the base flange facing the first guide ridge, but at a greater distance from the web than the first guide ridge, the web, the two guide ridges and the respective portions of the flange between the web and the guide ridges defining the inner space of the vertical member, each bracket is in the shape of a rigid angle plate having an inner end and an outer end, the inner end of which is positioned in a vertical member with its axis perpendicular to the plane of the base flange, and comprises a vertical side plate of a height smaller than the bracket length which side plate is positioned outside and adjacent to the first guide ridge parallel to the plane of the web, and at its inner end adjacent to the inner-space face of the second guide ridge, and a horizontal top plate of a width commensurate with the width of the outer flange, extending from the top of the side plate in the direction of the channel web, said topplate being divided by a cross-wise extending cut-out into an inner portion corresponding in shape and size to the inner space of the vertical member and into an outer portion distanced from the outer channel flange by a gap sufficient to allow tilting of the bracket in its vertical plane for the sidewise insertion of the inner portion into the inner space of the vertical member.

2. In a shelf support structure as defined in claim 1, a bracket the top plate of which is provided with holes for fastening thereto a shelf board.

3. In a shelf support structure as defined in claim 1, a vertical member the base flange of which is provided with holes for fastening the member to a wall by means of bolts or screws.

4. A vertical member as defined in claim 3 wherein the base flange is continued to the outside of the channel web in the shape of a narrow strip provided with holes for fixation of the vertical member.

5. A vertical member as defined in claim 3 wherein the holes in the base flange are surrounded by a semi-closed lipped channel adapted for the insertion of a resilient cover strip.

6. A vertical member as defined in claim 1 provided with a third guide ridge projecting out of the inside of the base flange parallel to the second guide ridge and forming with the latter a groove for insertion and guiding the inner end of the vertical side plate of the bracket.

* * * * *